United States Patent [19]

Kohler

[11] 3,973,416

[45] Aug. 10, 1976

[54] KNITTING MACHINE

[75] Inventor: Fritz Kohler, Couvet, Switzerland

[73] Assignee: Edouard Dubied et Cie (Societe Anonyme), Couvet, Switzerland

[22] Filed: Mar. 21, 1975

[21] Appl. No.: 560,967

[30] Foreign Application Priority Data

Mar. 27, 1974 Switzerland ..... 4261/74

[52] U.S. Cl. ..... 66/64

[51] Int. Cl.[2] ..... D04B 7/04

[58] Field of Search ..... 66/60, 64, 157

[56] References Cited

UNITED STATES PATENTS

| | | | |
|---|---|---|---|
| 3,049,900 | 8/1962 | Bram | 66/60 |
| 3,153,922 | 10/1964 | Bram | 66/64 |
| 3,613,401 | 10/1971 | Jeffcoat et al. | 66/60 |
| 3,685,317 | 8/1972 | Giachetti et al. | 66/64 |
| 3,839,884 | 10/1974 | Flavell et al. | 66/64 |
| 3,842,623 | 10/1974 | Flavell et al. | 66/64 |

*Primary Examiner*—Ronald Feldbaum
*Attorney, Agent, or Firm*—Hume, Clement, Brinks, Willian, Olds & Cook, Ltd.

[57] ABSTRACT

The disclosure relates to a stitch press movement mechanism for a knitting machine having at least two needlebeds. The movement mechanism is based upon the rotational movement of a serrated wheel in engagement with a single rack. The movement or change of positions of the stitch press slide blocks is accomplished by the interaction and cooperation between a lever attached to the stitch press and a lug and a raised bearing surface located on the serrated wheel. The stitch press movement mechanism disclosed is particularly advantageous because it eliminates a number of the blows or jolts received by the fragile stick press slide blocks and thus promotes longer equipment life.

9 Claims, 2 Drawing Figures

KNITTING MACHINE

The present invention relates to a knitting machine comprising at least two needlebeds arranged in roof form, provided with needles which can cross each other during their upward movement, a carriage being displaced in an oscillating movement on the frame parts and provided with at least one knitting system for the control of the needles during its displacement in alternating directions, and at least one stitch pressing means which seats on the stitches held in the needle hook and moving synchronously with the needle control. Also, a device for the alternating control of the stitch press in an adequate position for the movement of said stitch press along a row of needles and into another position for movement in the opposite direction, said alternating control of the stitch press being accomplished by a stop system actuating a rack and a kinematic chain of movement for reversing the stitch presses.

In a straight-line knitting machine where the needles are controlled by locks fastened to the carriage and capable of controlling said needles in both oscillating movement of the carriage, it is known to fasten a device for the control of the stitch presses directly to the carriage. It is also common practice to assign two stitch presses to each knitting system, or each pair of a knitting system if the knitting is done on two frames, so that one of the stitch presses operates when the carriage moves in one direction and the other one works when the carriage is moved in the opposite direction.

It is also known to only assign one stitch press to each knitting system or pair of a knitting system when knitting on two frames and to change the position of said stitch box at the end of each stroke of the carriage, so that it can operate successively in two opposite directions.

The usual method for the movement of the stitch presses from one position to the other requires a longer displacement of the carriage so that the change of position is made outside the knitted material.

The system of movement of the stitch presses described in the German patent (German Publication Copy No. 2,323,688.6) consists of racks and serrated wheels. The change of position is accomplished when the carriage arrives at the end of its travel and during the start of the travel in the opposite direction. One disadvantage of this method is the repetition of blows by contact with the stops. The first blow takes place when the complete device arrives at the stop and the second one when the lugs 57, 58 come in contact with the levers 54 which bear the slide blocks 11, 12, 13, 14 to cause them to swivel into the other position. The slide blocks of the stitch presses are very fragile and the jolts caused by this method are too consequential. On the other hand, the number of parts of the device cause masses of inertia to be very high and they are unfavorable.

The object of the invention is to create a simple device which easily can be adapted to conventional knitting machines. Said device also must control the reversing of the stitch presses over a very short distance without hitting the stitch presses and by not reducing the field width of the knitting. The masses of inertia in motion must be as small as possible.

The machine, according to the invention, is characterized by the fact that the kinematic chain of motion is created by a Malta cross device, one whose components form one piece with a serrated wheel engaging with the rack and its other component which bears the stitch presses is propelled by a member forming one piece with said serrated wheel.

The attached drawing exemplifies one embodiment of the knitting machine which is the subject of the invention.

Figures 1, 2:
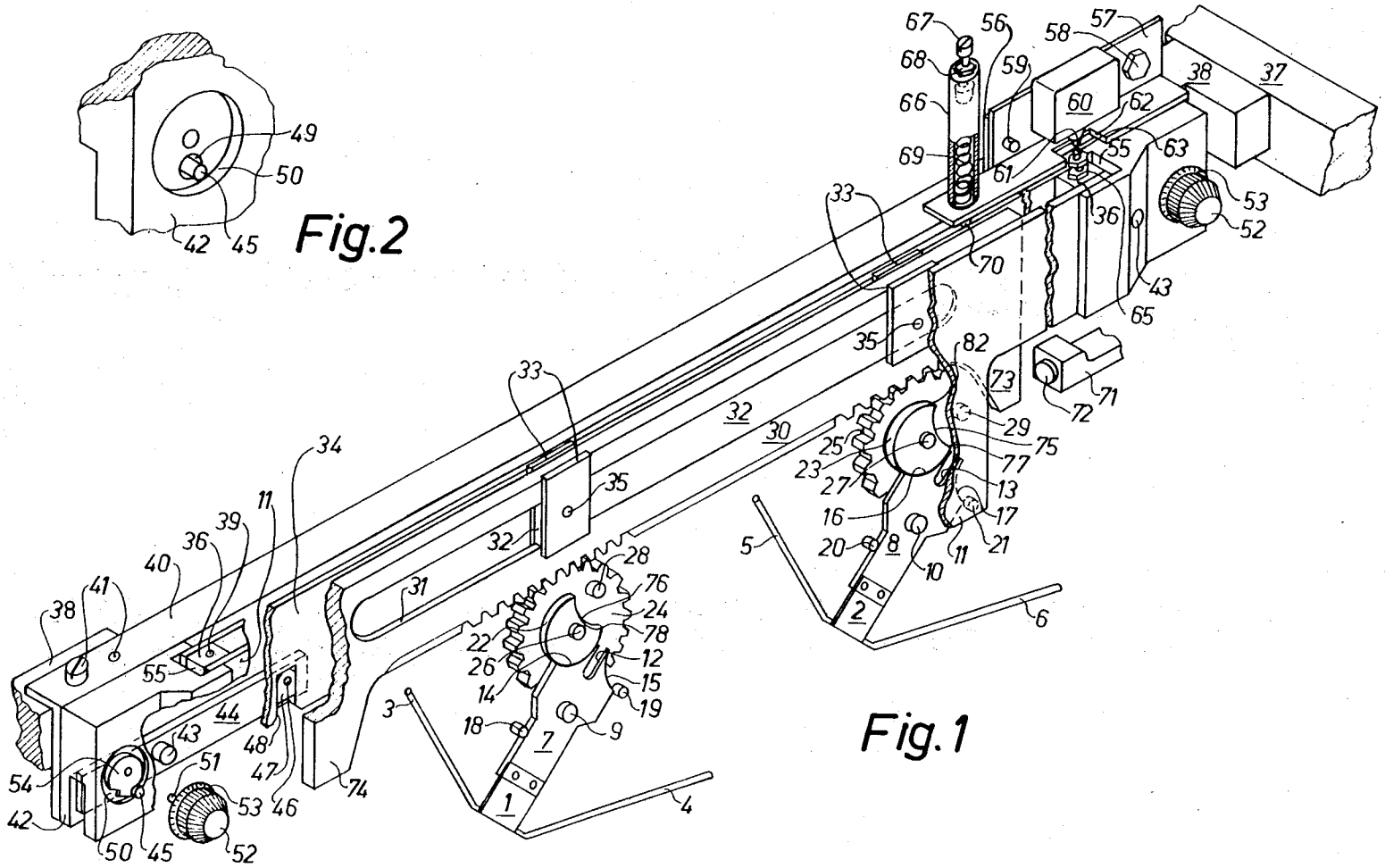
FIG. 1 is an isometric partial projection where certain parts have been removed while others are represented in a blown-up manner.
FIG. 2 is a partial isometric projection of one detail of FIG. 1.

The stitch presses 1 and 2 each include two slide blocks 3 and 4 and 5 and 6 respectively, and each of them is fastened to a lever 7 and 8, respectively. The fixation means of the slide blocks on the stitch presses and of the stitch presses on the levers 7, 8 are known and will not be described in greater details within the scope of this application. The lever 7 and/or 8 is mounted pivotably on a shaft 9 and/or 10 forming one piece with a front plate 11 partly shown in this figure. The end of this lever 7 and 8, respectively, which is most proximal to the shafts 9 and/or 10 for the pivoting is machined in the shape of a Malta cross or more exactly in the form of only part of the usually known Malta cross. This Malta cross part comprises a groove 12 and 13 respectively and disengagements 14, 15 and/or 16, 17. The levers 7 and 8 respectively can pivot about their respective axis 9 and 10 within limits formed by the stops 18, 19 and/or 20, 21 forming one piece with the front plate 11 on the one hand and by conjugation of the disengagement forms 14, 15 and/or 16, 17 with the bearing surface 22 and/or 23 of the serrated wheel 24 and 25 respectively pivoting about a shaft 26 and/or 27 forming one piece with the front plate 11, on the other hand. The serrated wheels 24 and/or 25 also have fixed lugs 28 and/or 29 and engage with a rack 30. The rack 30 has an aperture 31, slides on the guide 32 and is guided radially by the flanges 33. The flanges 33 and the guide 32 form one piece with a dorsal plate 34 by fixation means 35.

The front plate 11 and the dorsal plate 34 are separated and form one piece with either one of the cross-pieces 36 and fixation means not shown.

The assembly of these two plates (11, 34) and of all parts described so far will hereinafter be called in this specification, the mobile unit of the device.

The apparatus is fastened on the stirrups 37, partly shown, and already known, of a knitting carriage, itself not shown, by supporting means 38 and by fixation means not shown. A longitudinal support 40 is fastened to the supports 38 by fixation means 41. It connects the supports 38 fastened to each strirrup 37 of the carriage and constitutes the basis of the apparatus.

A fork 42 is fastened to each end of the longitudinal support 40 by fixation means not shown. A lever 44 pivots on a shaft 43, forming one piece with said fork 42. A lug 45 is fastened to one end of this lever 44, that is the end most proximal to the shaft 43, and a shaft 46 is fastened to the other end on which a nut or sheave 47 can pivot freely; said nut 47 has room in an opening 48 of the dorsal plate 34. The lug 45 of the lever 44 emerges via a hole 49 (FIG. 2) into a disengagement 50 of the fork 42.

A button 52 and a slide 53, shown blown up in FIG. 1, are mounted on a shaft 51 located in the center of the disengagement 50 and forming one piece with the fork 42.

The slide 53 freely pivots about the shaft 51 and has a cam 54. Said cam 54 forming one piece with the slide acts by its shape during the rotation of the slide 53 on the lug 45 which has the effect that the lever 44 is caused to pivot about its shaft 43. The button 52 is used to block the cam 54 and thus the slide 53 in a selected position. Its operation is known and thus will neither be shown nor described with the scope of this application.

The mobile unit of this apparatus, as described before, is placed in suspension on the nuts or sheaves 47 in the opening 48 of the forks 42.

A support 57 pivoting about the shaft 58 forming one piece with the support 56 is mounted on the support 56 which is fastened on the longitudinal support 40 by fixation means not shown on either side of the apparatus. The support 57 is positioned in relation to the support 56 by means of a removable peg 59.

The electrical switch 60 forms one piece with the support 57 and its contact 61 forms in this respect by the opening 62 of the support 57 opposite a stop 63 one piece with the crosspiece 36. This stop 63 is vertically adjustable and can be positioned by the locknut 65.

A compensation system 66 consisting of an adjustment screw 67, a blocking nut 68, a spring 69, a sensor 70, forms one piece with the support 57. The sensor 70 presses on the dorsal plate 34 of the mobile unit.

The partially shown stop 71 forms one piece with the machine frame (not shown) and has a pellet 72 allowing for the deadening of the noise when the stop 73 of the rack 30 strikes against this stop 71.

To facilitate the comprehension of the drawing, certain parts of the apparatus are shown only at one end. However, it should be understood that a similar arrangement is place at the other end of the knitting machine and of the apparatus. For example, a stop 71 exists at the other end of the knitting machine which coacts with the stop 74 of the rack 30. The same applies to the compensation system 66, the electric switch 60 and the lever system 44 with its nut 47 being fastened to each end of the apparatus.

The operation of the stitch press and the position of the slide blocks of the stitch press in relation to the needles of a straight line knitting machine is described in the German patent (German Application, Publication Copy P 19 561 90.1) and will not be described in greater detail within the scope of this application.

FIG. 1 shows the position of the stitch press device (1, 2) at the moment when the carriage has started its movement from right to left, seen from the operator's station.

As the carriage arrives at the left of the knitting machine, outside the field of the needles, the carriage starts its deceleration in a manner known and not described here.

The stop 74 hits against the stop 71 (not shown on the left) and maintains the rack 30 immobile in relation to the frame of the knitting machine (not shown). The carriage continues its travel so that the rack 30 slides on the guide 32. The front plate 11 which indirectly forms one piece with the carriage is moved in relation to the rack 30 so that the serrated wheels 24 and 25 respectively, held by their engagement with said rack will rotate around shafts 26 and 27 respectively, which form one piece with the front plate 11. If the carriage is moved from right to left the serrated wheels 24, 25 rotate clockwise.

The angular displacement of said dented wheels permits, in this position, the lug 29 to enter the groove 13 of the lever 8 before the lug 28 enters the groove 12 of the lever 7. This angular displacement makes it possible to prevent the slide blocks 4 and 5 from colliding during the rotation of the stitch presses. During the movement of the carriage in the opposite direction, that is from left to right, the lever 7 pivots about its shaft 9 before the lever 8 pivots about its shaft 10 to prevent the slide blocks 4 and 5 from colliding.

In the case we are describing here, that is movement from right to left, the lug 29 moves the lever 8 about its shaft 10 as soon as the stop 77 of the bearing surface 23 has exceeded a line connecting the shafts 10 and 27, the disengagement 75 permitting free passage of the end of lever 8.

During the rotation of the lever 8, the lug 28 moves the lever 7 about its shaft 9 as soon as the stop 78 of the bearing surface 22 has exceeded a line connecting the shafts 9 and 26, the disengagement 76 permitting free passage of the end of the lever 7. As soon as the stop 82 of the bearing surface 23 has cleared the line connecting shafts 10 and 27, the lever 8 is no longer displayed by the lug 29 and it arrives against the stop 21. The disengagement 17 allows the wheel 25 to continue to rotate and the conjugation of the forms of the bearing surface 23 and of the disengagement 17 form the bolting of the lever 8. To avoid too high a machining precision of the bearing surface 23 and of the disengagement 17, the diameter of the stop 21 will be adjusted once and for all during the assembly of the apparatus to compensate for the play which might exist between the bearing surface 23 and the lever 8. The same applies to the stops 18, 19 and 20.

The pivoting of the lever 7 is effected in the same manner as that of the lever 8. Once both pivotings are completed, the linear speed of the carriage continues to decrease until zero and the carriage starts again in the opposite direction, the stitch presses 1 and 2 then are in working position.

The vertical adjustment of the position of the slide blocks 3 and 5 or 4 and 6 in relation to the needles is accomplished by means of the slides 53 and the cam 54 located at each end of the apparatus.

The shock from one needle against the slide blocks 3 and 5 or 4 and 6 during the knitting raises the mobile unit so that one of the two or both stops 63 located at each end of the apparatus (the one on the left is not shown, it would be fixed in the hole 39 of the crosspiece 36) urges the contact 61 of the switch 60 which operates like a short circuit causing by means known and not shown the braking and stopping of the carriage. The feeding device of the switches by means of slides rubbing on a rail parallel with the movement of displacement of the carriage is likewise known and not shown.

The function of the compensation system 66 is to assure the position of the mobile unit on the nuts or sheaves 47 and permits adjustments by the screw 67, and the spring 69, of the force required to raise said mobile unit so that possible vibrations of the knitting machine cannot trigger the switch 60 too easily.

The disassembling of the mobile unit is easily accomplished by removing the removable pegs 59 and causing the support 57 to pivot about its axis 58. The mobile unit thus can be lifted and removed by hand.

The knitter thus is provided with a simple, easily dismantable apparatus providing him or her with a greater variety in the selection of the pieces to be knit on one automatic knitting machine.

What is claimed is:

1. A knitting machine having at least two needlebeds arranged in roof form provided with needles which can cross each other during their upward movement, a carriage being displaced in an oscillating movement on the a kinematic parts and provided with at least one knitting system for the control of the needles during its displacement in alternating direction, at least one stitch pressing means which seats on the stitches held in the needle hook and moves synchronously with the needle control, and a means for the alternating control of the stitch press from an adequate position for the movement of said stitch press along a row of needles into another position for movement in the opposite direction, the alternating control of the stitch press being accomplished by a system of stops actuating a rack and akinematic chain of movement for the reversing of the position of the stitch press, wherein the chain of movement comprises the circular motion of a serrated wheel mounted on a shaft connected to the carriage and in disengagement with the rack, which motion is transformed into the movement of the stitch press from one position to the other through a lever attached to the stitch press and mounted on a shaft connected to the carriage which cooperates with raised portions of the serrated wheel, and wherein the lever has a groove at the end opposite the stitch press for cooperation with a lug projecting from the serrated wheel for the movement of the stitch press from one position to the other and has a pair of disengagement surfaces adjacent the groove for cooperation with a raised, curved bearing surface on the serrated wheel to prevent the movement of the stitch press except when the lug is in cooperation with the groove.

2. The knitting machine of claim 1, wherein the raised bearing surface includes a disengagement portion for cooperation with the groove end of the lever to permit unhindered movement of the lever and the stitch press from one position to the other.

3. The knitting machine of claim 1, wherein the limits of movement of the lever are defined by a pair of stops connected to the carriage.

4. The knitting machine of claim 1, wherein the movement of the stitch press from one position to the other is accomplished during the movement of the carriage in a single direction.

5. The knitting machine of claim 4, wherein the movement of the stitch press from one position to the other occurs while the carriage is decreasing its linear speed.

6. A knitting machine, having at least two needlebeds arranged in roof form with needles which can cross each other during their upward movement, a carriage for movement in successively opposite directions on the frame of the knitting machine provided with at least one knitting system for the control of the movement of the needles in conjunction with the movement of the carriage, and at least one stitch press for seating on the stitches held in the needle hook which press has two positions and is arranged in one position for movement along the needlebeds in conjunction with the movement of the carriage in a given direction and is arranged in another position for movement with the carriage in the opposite direction, which comprises:

a. a lever attached to the stitch press having a groove at the end opposite the stitch press and a pair of disengagement surfaces adjacent the groove and which is mounted to pivot about a shaft connected to the carriage;

b. a serrated wheel mounted on a shaft connected to the carriage and having a lug for cooperation with and insertion in the groove in the lever for the movement of the stitch press from one position to the other and a raised, curved bearing surface for cooperation with the pair of disengagement surfaces of the lever, the bearing surface including a disengagement portion opposite the lug for cooperation with the grooved end of the lever to permit unhindered movement of the lever from one position to the other;

c. a rack for engagement with the serrated wheel; and d. means for stopping the movement of the rack relative to the movement of the carriage so that the further movement of the carriage in the given direction causes the serrated wheel to rotate and move the stitch press from one position to the other.

7. The knitting machine of claim 6, which comprises at least two stitch presses and wherein the lugs and the disengagement portions of the bearing surfaces on each of the serrated wheels have different angular placements to permit the stitch presses to be moved from one position to the other at different times in order to prevent the presses from colliding.

8. The knitting machine of claim 6, wherein the limits of movement of the stitch presses are defined by a pair of stops connected to the carriage.

9. The knitting machine of claim 6, wherein the movement of the stitch press from one position to the other is accomplished while the carriage is decelerating prior to changing its direction of movement.

* * * * *

UNITED STATES PATENT AND TRADEMARK OFFICE

CERTIFICATE OF CORRECTION

PATENT NO. : 3,973,416

DATED : August 10, 1976

INVENTOR(S) : Fritz Kohler

It is certified that error appears in the above-identified patent and that said Letters Patent are hereby corrected as shown below:

Column 4, line 21, "displayed" should read - - displaced - - .
Column 4, line 57, "adjustments" should read - - adjustment - - .
Claim 1, line 6, "a kinematic" should read - - frame - - .
Claim 1, line 22, "disengagement" should read - - engagement - - .

Signed and Sealed this

Thirtieth Day of November 1976

[SEAL]

*Attest:*

RUTH C. MASON
*Attesting Officer*

C. MARSHALL DANN
*Commissioner of Patents and Trademarks*